United States Patent [19]

Ikeya

[11] 4,444,599

[45] Apr. 24, 1984

[54] METHOD FOR PREVENTING HYDROGEN EMBRITTLEMENT OF METALS AND ALLOYS

[75] Inventor: Motoji Ikeya, Ube, Japan

[73] Assignee: Yamaguchi University, Yamaguchi, Japan

[21] Appl. No.: 384,099

[22] Filed: Jun. 1, 1982

[30] Foreign Application Priority Data

Jun. 9, 1981 [JP] Japan ..... 56-87551

[51] Int. Cl.[3] ..... B01J 1/10

[52] U.S. Cl. ..... 148/4; 148/13; 204/157.1 H

[58] Field of Search ..... 148/4, 13, 1; 204/157.1 R, 157.1 H

[56] References Cited

U.S. PATENT DOCUMENTS 3,804,734 4/1974 Richard et al. ..... 204/157.1 H
3,817,849 6/1974 Richard et al. ..... 204/157.1 H
4,000,011 12/1976 Sato et al. ..... 148/4
4,122,240 10/1978 Banas et al. ..... 148/4

FOREIGN PATENT DOCUMENTS 229305 2/1959 Australia ..... 204/157.1 H

OTHER PUBLICATIONS

Metals Handbook 9th Edition, vol. 4, pp. 518–521, 11/81.

*Primary Examiner*—L. Dewayne Rutledge
*Assistant Examiner*—S. Kastler
*Attorney, Agent, or Firm*—Spencer & Frank

[57] ABSTRACT

Hydrogen, embrittlement in metals, alloys or welded portions thereof, which causes cracks, breakage and the like, is prevented by emitting an ionizing radiation to a metal, alloy or a welded portion thereof to diffuse and exhale hydrogen charged in said metal.

3 Claims, 5 Drawing Figures x200 x 200 x 200

METHOD FOR PREVENTING HYDROGEN EMBRITTLEMENT OF METALS AND ALLOYS

BACKGROUND OF THE INVENTION (1) Field of the Invention

The present invention relates to a method for preventing hydrogen embrittlement in metals and alloys.

(2) Description of the Prior Art

Heretofore, it has been well known that in welding, casting, rolling and the like of a metal or alloy, hydrogen atoms diffuse into the metal and variations in its mechanical properties, such as crack, breakage and the like occur, which is a commercial problem known as "hydrogen embrittlement". In order to prevent this hydrogen embrittlement, there is only one process wherein hydrogen is diffused and exhaled through thermal annealing (heating) but this process is not fully satisfactory for the prevention of hydrogen embrittlement. In particular, breakage due to hydrogen embrittlement still occurs at welded portions of large plants and in nuclear reactor fuel cladding (Zircaloy). Sudden breakage of a cast metal or alloy is presumably caused by to the progress of a slight break or crack due to the diffusion and aggregation of the residual hydrogen, and as a method for preventing such hydrogen embrittlement, there has been no process other than thermal annealing. In order to save energy reduction of the thermal annealing time is desired and a method for removing hydrogen from electrolytically refined copper or a cast, a welded portion and the like has been demanded.

SUMMARY OF THE INVENTION

The inventor has made various studies in order to overcome the defects in the prior method for preventing hydrogen embrittleness, and has found that when a hydrogen-charged metal or alloy is irradiated with ionizing radiation (X-ray, $\gamma$-ray, electron beam, $\beta$-ray, $\alpha$-ray and the like), a hydrogen compound is decomposed and the diffusion of hydrogen is increased considerably. Regarding hydrogen in metals, a large number of studies have been made with respect to hydrogen storage for providing clean energy, purification of hydrogen through a palladium diaphragm and hydrogen embrittlement, but such phenomenon has never been found.

As mentioned above, when an ionizing radiation impinges on a hydrogen-charged metal or alloy, the hydrogen exhalation is increased and the hydrogen diffusion is promoted. While the detailed physical mechanism has not been clarified, the following fact has been considered. Namely, if an inner shell of a metal atom is ionized by an ionizing radiation, an electron chemically bonding to a hydrogen atom or an outer shell electron of the metal is is transferred to the inner shell. In the latter case, an electron chemically bonding to the hydrogen atom is ionized through the Auger effect. In the former case, the ionized hydrogen atom, that is a proton may be expelled. In addition, it can be considered that the reason for this phenomenon is based on the fact that a molecular orbit of a hydrogen atom and a neighbor metal has been formed and the electron bond with the hydrogen atom is cut by radiation excitation. It is also considered that an ionizing electron formed by radiation conducts an elastic or non-elastic collision with a light hydrogen atom and energy is given to the hydrogen.

The present invention utilizes such hydrogen behavior and has as an objective to diffuse, disperse and exhale hydrogen by irradiating a metal, alloy or a welded portion wherein hydrogen or a formed hydrogen compound is accumulated, and which would cause cracks due to hydrogen embrittlement in a nuclear reactor or other industrial plant. This is accomplished with external radiation that prevents the formation of hydrogen embrittlement or enhances the exhalation of hydrogen by irradiating a hydrogen storaged metal used as a hydrogen storage with an external radiation.

For carrying out the method of the present invention in a practical manner, it is merely necessary to irradiate a metal, alloy or a welded portion thereof with an ionizing radiation during heating or at room temperature. In this case, the radiation energy must have a satisfactory permeating and penetrating force and an ionizing radiation, such as the usual X-rays, $\gamma$-rays or an, electron beam, preferably X-rays having a high energy or $\gamma$-rays from $^{60}Co$, $^{137}Cs$, is locally emitted.

The present invention will be explained in more detail.

DESCRIPTION OF THE PREFERRED EMBODIMENTS

The present invention will be explained with respect to the drawings.

Figure 1A:
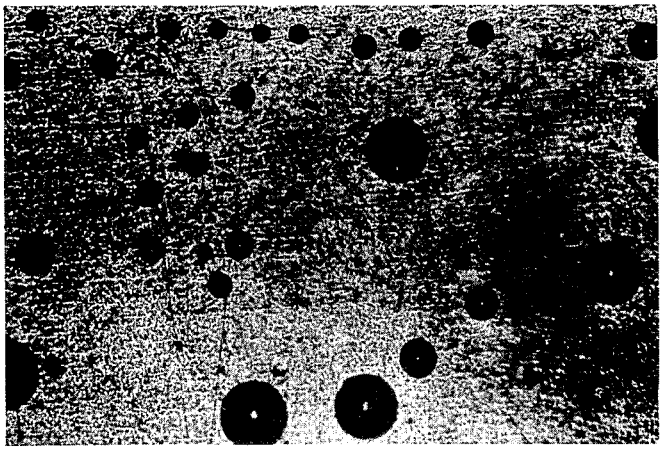
FIG. 1*a* is a micrograph of hydrogen bubbles exhaled from a hydrogen-charged stainless steel specimen coated with glycerine when said stainless steel specimen is irradiated with X-ray.
Figure 1B:
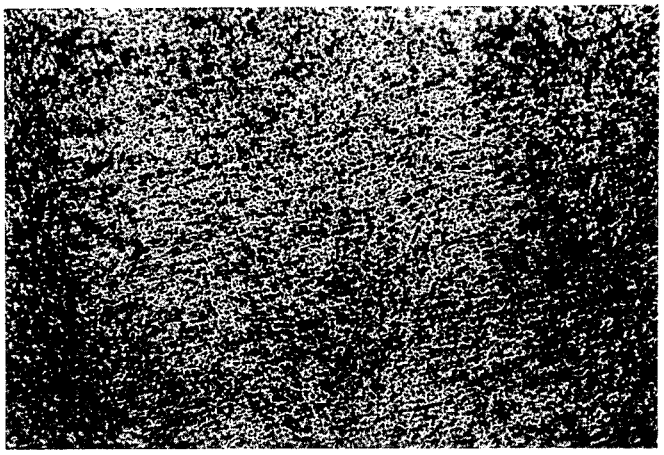
FIG. 1*b* is a micrograph of a non-irradiated site of the stainless steel specimen of FIG. 1*a;*

FIG. 1*a* is a micrograph (magnification: 200) showing that hydrogen bubbles are exhaled from a surface of a hydrogen-charged stainless steel (SUS 304) specimen when said specimen is irradiated with X-ray of about $10^5$ rad, and FIG. 1*b* is a similar micrograph of the non-irradiated site. Liquid glycerine is coated on a surface of said stainless steel in order to observe the exhalation hydrogen, but the hydrogen bubbles shown in FIG. 1*a* are not formed due to decomposition of glycerine owing to irradiation of the glycerine. This has been confirmed by using SUS in which hydrogen is not diffused. It is not necessary to confirm the formation of the hydrogen bubbles by means of a microscope since said formation can be satisfactorily observed with a magnifying glass and the like and this test can be utilized as a method for detecting the amount of residual hydrogen in a metal, alloy or a welded portion thereof in a factory.

From the glycerine bubble formation shown in FIG. 1*a* and the variation of the lattice constant by X-ray diffraction, the following fact has been found.

When an SUS specimen is irradiated with an ionizing radiation of about $10^5$ rad, hydrogen stably charged in said specimen is exhaled from the specimen surface as gas. This irradiation effect is more noticeable at a higher temperature. The temperature and conditions of irradiation differ according to the metal and alloy to be treated and the hydrogen content and the exhalation rate of hydrogen at room temperature is accelerated about twice with about $10^5$ rad/hour of X-ray irradiation and this rate is enhanced with increase of the radiation dose. At this degree of ionizing radiation, metals are not damaged by the radiation and only hydrogen or a hydrogen compound in the metals is decomposed.

Figure 2:
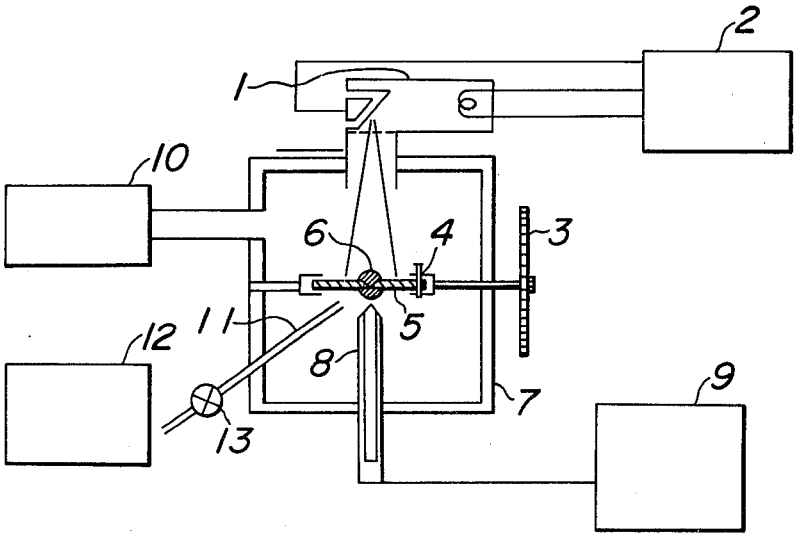
FIG. 2 and FIG. 3 are schematic views illustrating apparatuses for carrying out the method of the present invention.

In an apparatus shown in FIG. 2, a metal specimen 5 is held by a holder 4 in a lead or iron container 7 for shielding radiation, which has a thickness of about 1 mm and if necessary, rotated by means of a rotary mechanism and welded with a welding machine 8. Immediately after welding. hydrogen can be exhaled from the welded portion 6 by irradiating the welded portion with X-rays, X-rays being emitted from a radiation source consisting of X-ray tube 1 and a voltage supply source 2. The magnitude of the applied voltage is sufficient to provide a force capable of permeating the thickness of the welded portion about 100–150 KV being preferable. When the specimen is thin, the applied voltage may be about 50 KV.

As a radiation source replacing the above described X-rays, use may be made of an electron beam in vacuum or γ-rays from $^{137}Cs$ (cesium 137) and $^{60}Co$ (Cobalt 60). Irradiation of X-rays is carried out while annealing by means of a welding machine 8. 9 is an electric power source or a gas source of the welding machine, 10 is a vacuum evacuating device, 11 is an inert gas injecting nozzle, 12 is a gas source and 13 is a cock. When hydrogen is forcedly exhaled for preventing hydrogen embrittlement, the efficiency is increased by effecting such a process under heating by supplying gas from the above described gas source 12 and evacuating by means of the vacuum evacuating device. If the welding is effected in this manner and then the radiation is emitted, hydrogen embrittlement in the metal specimen and the welded portion is prevented.

Another example wherein hydrogen embrittlement is prevented by irradiating a casting immediately after casting with an ionizing radiation, will be explained with reference to FIG. 3.

Figure 3:
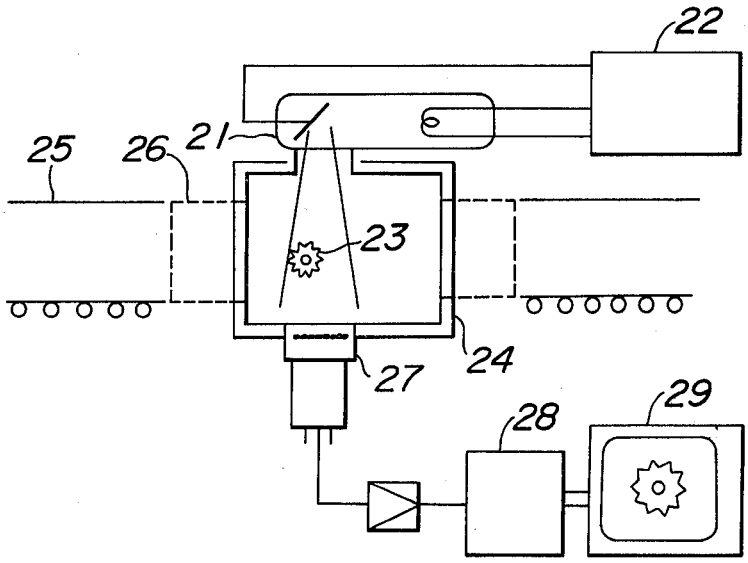

In FIG. 3, 21 is an X-ray tube, 22 is an electric power source, 23 is a cast article, 24 is a shielding box (lead plate lining) for safety, 25 is a belt conveyer, 26 is an automatic door, 27 is an image pick-up tube having a high sensitivity, 28 is a signal processor and 29 is a television monitor.

As shown in FIG. 3, the casting 23 is introduced into the shielding box 24 through the door 26, X-rays having a high voltage are emitted from the X-ray tube 21 at a voltage of 150 KV and the casting is dehydrogenated while detecting the crack and damage in the casting by means of the image pick-up tube 27, the signal processor 28 and the television monitor 29.

Instead of X-ray tube 21 and the power source 22, a γ-ray irradiating device may be used and the image pick-up tube 27, the signal processor 28 and the television monitor 29 may be omitted.

Figure 4:
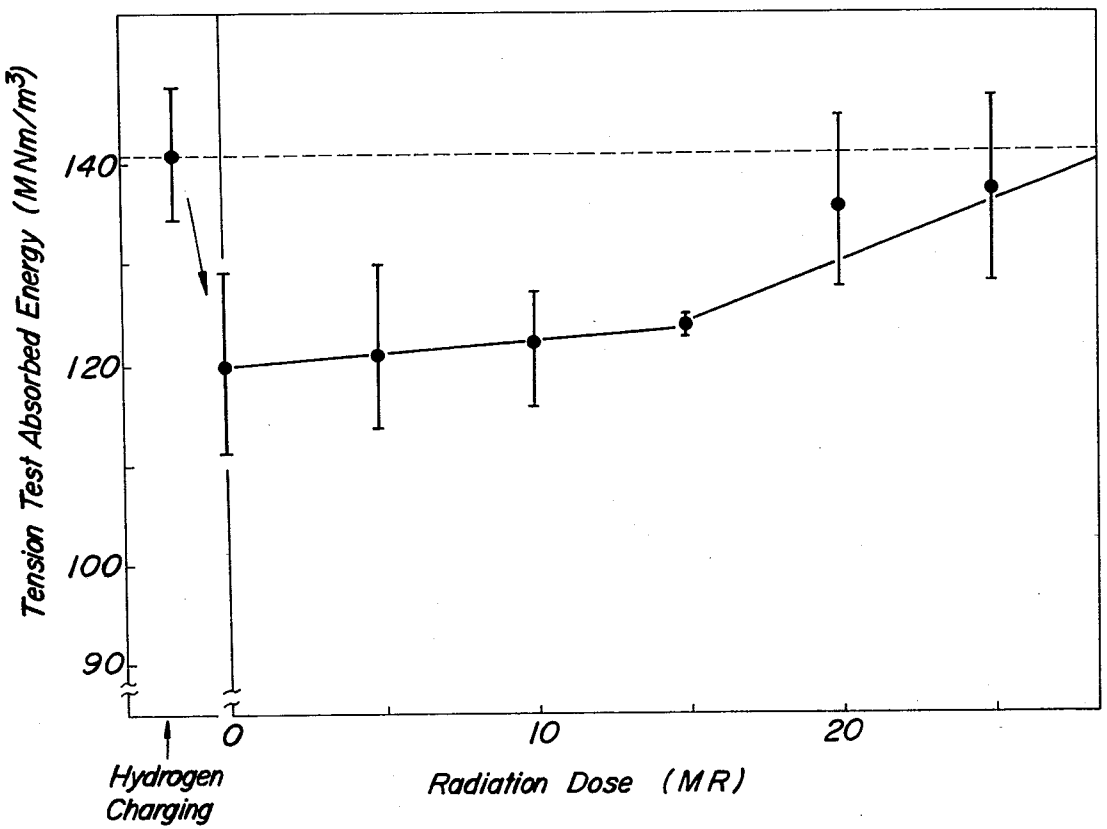
FIG. 4 is a graph showing the relation of the absorbed energy to the radiation dose in hydrogen charged carbon steel SS 41 in tensile test.

A further example using carbon steel SS 41 is shown with reference to FIG. 4.

Hydrogen was electrolytically charged in the above described steel SS 41 and after a few days, a tensile test was made, the results obtained being shown in FIG. 4.

From FIG. 4 it can be seen that in the specimen irradiated with γ-ray, the hardness due to hydrogen is recovered and as the radiation dose is increased, the viscosity is increased and the hydrogen embrittlement is recovered.

In the metals wherein hydrogen is forcedly diffused and exhaled through irradiation of radiation, the hydride phase has apparently disappeared when detection is carried out by means of X-ray diffraction and the martensite transformation is restrained.

According to the method of the present invention, the problems of hydrogen embrittlement of metals and alloys are solved and the breakage at the welded portions in large plants, the breakage due to hydrogen embrittlement in nuclear reactor fuel cladding and the like are prevented, and the formation of breaks and crack in cast metals is remarkably reduced. Thus the present invention considerably contributes to the improvement of the quality of metal materials.

What is claimed is:

1. The method of treating a hydrogen-charged metal or alloy specimen to minimize hydrogen embrittlement thereof, said method comprising the steps of supporting said specimen within a shielded container;

radiating said specimen with an ionizing radiation having a magnitude sufficient to diffuse the hydrogen therein and cause its emission from the specimen without disturbing the surface of said specimen, said ionizing radiation being x-rays having a magitude of approximately $10^5$ rads per hour; and removing said specimen from said container.

2. The method defined by claim 1 which includes the step of annealing said specimen prior to the application of ionizing radiation thereto.

3. The method defined by claim 1 wherein said specimen is a casting, and which includes the further step of inspecting said casting on a monitor during radiation with said ionizing radiation.

* * * * *